US011553788B1

(12) United States Patent
Jeong

(10) Patent No.: US 11,553,788 B1
(45) Date of Patent: Jan. 17, 2023

(54) STRUCTURE FOR PREVENTING DEFORMATION OF READING TABLE

(71) Applicant: NICE PRODUCTION CO., LTD., Pocheon-si (KR)

(72) Inventor: Il Hun Jeong, Pocheon-si (KR)

(73) Assignee: NICE PRODUCTION CO., LTD., Pocheon-si (KR)

( * ) Notice: Subject to any disclaimer, the term of this patent is extended or adjusted under 35 U.S.C. 154(b) by 0 days.

(21) Appl. No.: 17/504,749

(22) Filed: Oct. 19, 2021

(51) Int. Cl.
*A47B 19/06* (2006.01)

(52) U.S. Cl.
CPC ..... *A47B 19/06* (2013.01)

(58) Field of Classification Search
CPC ..... A47B 13/02; A47B 13/003; A47B 13/08; A47B 23/00; A47B 19/06
USPC ..... 108/1, 161; 248/441.1, 442.2, 444.1, 248/445, 446, 447, 448, 449, 450–453
See application file for complete search history.

(56) References Cited

U.S. PATENT DOCUMENTS 1,220,705 A * 3/1917 Tayte ..... A47B 23/042 248/453
1,483,421 A * 2/1924 Farnham ..... A47B 23/043 248/453
1,851,906 A * 3/1932 Henderson ..... A47B 41/02 312/316
2,374,409 A * 4/1945 Gallagher ..... A47B 23/043 248/456
2,583,097 A * 1/1952 Heimann ..... A47B 19/06 248/456
2,838,353 A * 6/1958 Emmert ..... A47B 3/0812 108/125
3,695,567 A * 10/1972 Weagle ..... A47B 3/0815 108/132
4,460,146 A * 7/1984 Raggiotti ..... A47G 1/142 248/456
4,618,119 A * 10/1986 Powell ..... A47B 23/043 248/456
5,492,299 A * 2/1996 Thermos ..... A47B 23/043 248/456
5,651,525 A * 7/1997 Yang ..... A47B 23/043 248/447
5,797,578 A * 8/1998 Graffeo ..... A47B 23/043 248/456

(Continued)

FOREIGN PATENT DOCUMENTS

KR 10-1064182 B1 9/2011
KR 101563328 B1 * 11/2015

*Primary Examiner* — Daniel J Troy
*Assistant Examiner* — Timothy M Ayres
(74) *Attorney, Agent, or Firm* — Schmeiser, Olsen & Watts, LLP

(57) ABSTRACT

Provided is a structure for preventing deformation of a reading table, which prevents deformation of a reading table itself, solves a problem that a gap is generated when a support of the reading table is rotated and coupled, and thus prevents a standing paper from falling off, and relates to a pressing structure for preventing deformation of a reading table, wherein a pressing member is located at a center of a rear surface of a reading table, and when a first support member is rotated at a predetermined angle, a central part of the reading table is pressed by a support member, and thus a predetermined interval is forcibly formed between the reading table and lower corners of two sides of the first support member.

2 Claims, 14 Drawing Sheets

(56) References Cited

U.S. PATENT DOCUMENTS

| | | | | |
|---|---|---|---|---|
| 8,205,561 | B1 * | 6/2012 | Bierworth | A61G 5/1094 108/157.11 |
| 8,424,465 | B2 * | 4/2013 | Florendo, Jr. | A47B 23/043 248/456 |
| 9,995,428 | B2 * | 6/2018 | Schwartz | A47B 23/04 |
| 2003/0029985 | A1 * | 2/2003 | Zeller | B42F 9/004 248/461 |
| 2006/0124822 | A1 * | 6/2006 | Munda | A47B 19/00 108/1 |
| 2007/0221811 | A1 * | 9/2007 | Hauser | A47B 23/043 248/454 |
| 2011/0056412 | A1 * | 3/2011 | Grammer | A45C 9/00 108/1 |
| 2020/0054124 | A1 * | 2/2020 | Jung | A47B 13/003 |

* cited by examiner

FIG. 6A
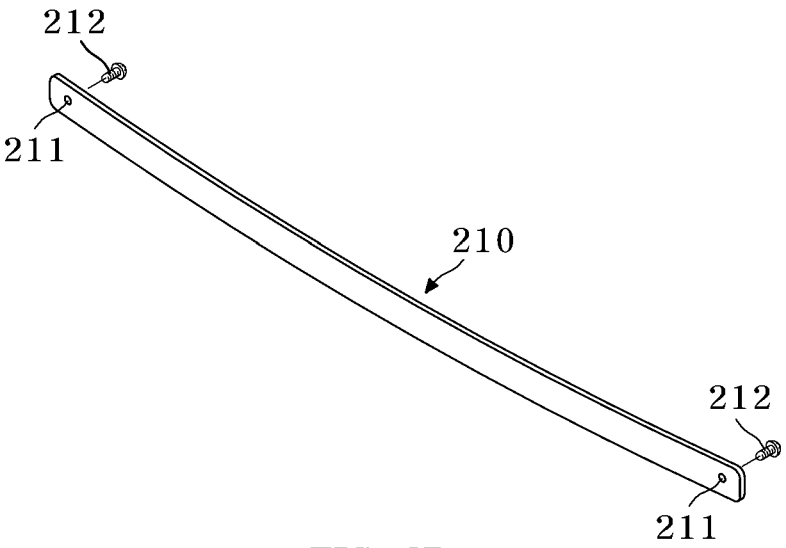
FIG. 6B
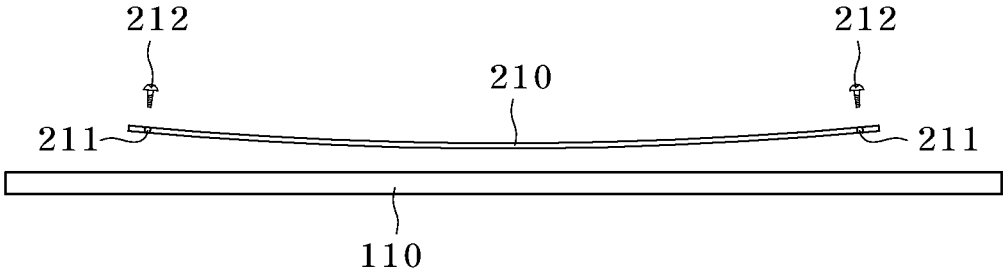
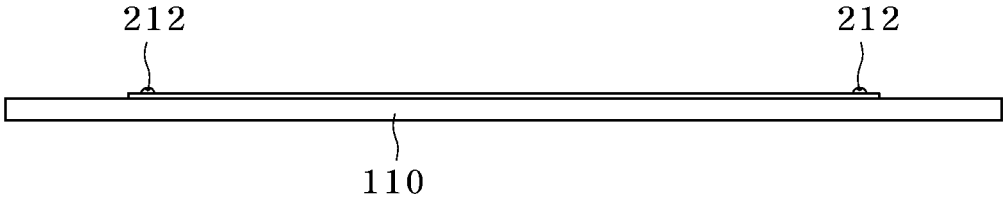
FIG. 6C

STRUCTURE FOR PREVENTING DEFORMATION OF READING TABLE

FIELD OF TECHNOLOGY

The following relates to a structure for preventing deformation of a reading table, and more particularly, to a structure for preventing deformation of a reading table that prevents deformation of a reading table itself and also solves the problem that a gap is generated when a support of the reading table is rotated and coupled to prevent standing paper from falling off.

BACKGROUND

In Korean Patent No. 10-1064182 invented by the present inventor, a structure of a reading/writing combination function support for a reading table was developed.

As illustrated in FIG. 1, one sides of unfolding pieces 20 are coupled to two lower sides of a book support reading table 10 formed to have a predetermined thickness so that a longitudinal length is longer than a vertical length and made of wood or a synthetic resin material, two sides of a book support 30 are inserted between the other sides of the unfolding pieces 20, that is, the one sides of the unfolding pieces 20 exposed to upper surfaces or front surfaces of the two lower sides of the book support reading table 10, and the two sides of the book support 30 inserted between the unfolding pieces 20 are rotatably coupled by a rotation pin.

Each of the unfolding pieces 20 has an unfolding hole 21 through which the rotation pin passes and is configured so that, while a portion of the rotation pin passes through the unfolding hole 21, a head 41 of the rotation pin may be caught by the unfolding hole 21.

The unfolding hole 21 through which the rotation pin passes is formed so that, while the rotation pin moves along a horizontal hole 22 and a vertical hole 23 in a state in which a lower portion of the vertical hole 23 is connected to an end of the horizontal hole 22, the unfolding hole 21 may rotate in a front-rear direction or a left-right direction above the vertical hole 23.

The length of the horizontal hole 22 is formed longer than the length of the vertical hole 23, which is a state in which, by pulling the book support 30, the book support 30 is extracted further outward from a lower part of the book support reading table 10 is maintained, and thus the book support reading table 10 may be used as widely as the extracted length.

A plurality of through-holes is formed in an upper part of a locking step 24 and are fixed to the two lower sides of the book support reading table 10 through screws 26.

Meanwhile, book leaf turning prevention rods 31 may be formed on two sides of the book support 30 to prevent a book leaf from being forcibly turned over, and a support that maintains an inclined state is coupled.

However, as illustrated in FIGS. 2 and 3, when a book support reading table 110 is used while a book is placed thereon, a book support is bent inward due to the weight of a book, and thus, when one or several papers 200A are inserted, the papers 200A fall out. When the book support reading table 110 is used in front of a desk, the book support reading table 110 is deformed due to the pressure of a hand that is used from a reading table linear part 202 in an initial manufacturing step to a reading table bending part 201 in a usage step.

Undescribed reference numeral 112 denotes a height adjustment unit, and undescribed reference numeral 130 denotes a support part.

SUMMARY

An aspect relates to preventing deformation such as bending of a reading table itself to prevent a paper or the like from falling out, and the purpose of the present disclosure is to provide a fastening structure that solves, by forming a fixing part of a book support (30), a problem that the book support (30) is not fixed easily because the book support (30) is shaken along a fine thickness of a book support reading table (10) manually made of wood and thus has no problem in rotation and is not shaken when being fixed.

Further, the purpose of the present disclosure is to support the reading table to prevent bending by recessing a quadrangular support bar accommodation groove in a quadrangular shape in a rear end side surface that is a rear end surface of a second fixing body so that the reading table is pushed forward to prevent bending of a central part of a reading table (110) while left and right ends of a quadrangular support bar are fitted.

Further, the purpose of the present disclosure is to improve a structure for preventing bending of the reading table itself simply using the existing product.

A structure for preventing deformation of a reading table includes a reading table (110) that is formed of a rectangular wooden board, a first support member (510) that includes a plurality of locking steps (518) located on an inner surface thereof, a pair of second support members (520) that are attached to left and right sides of a rear surface of the reading table (110), an angle adjustment member (530) that includes a pair of fitting parts (534) protruding from two ends of an upper portion thereof and locking parts (538) located at a lower end thereof, a pressing member (550) that has a plurality of coupling holes (552) and has a rectangular parallelepiped shape, wherein the pressing member (550) is located in a pressing member coupling part (511) of the first support member (510), and the first support member (510) and the pressing member (550) are coupled through coupling holes (512) and the coupling holes (552) using screws (554), fitting parts (524) of the pair of second support members (520) are each fitted in a corresponding one of coupling holes (514) on left and right sides of the first support member (510) to which the pressing member (550) is attached, and the fitting parts (534) of the angle adjustment member (530) are each fitted in a corresponding one of coupling parts (526) of the second support members (520), and the pressing member (550) is located at a center of the rear surface of the reading table (110), and when the first support member (510) is rotated at a predetermined angle, a central part of the reading table (110) is pressed by a support member (500), and thus a predetermined interval (dl) is forcibly formed between the reading table (110) and lower corners of two sides of the first support member (510).

The first support member (510) and the pressing member (550) may be integrally formed and have rounded shapes.

BRIEF DESCRIPTION

Some of the embodiments will be described in detail, with reference to the following figures, wherein like designations denote like members, wherein:

FIG. 6A is a perspective view, an exploded plan view, and a coupling plan view illustrating the reading/writing combination function support for a reading table according to the first embodiment of the present disclosure;

FIG. 6B is a perspective view, an exploded plan view, and a coupling plan view illustrating the reading/writing combination function support for a reading table according to the first embodiment of the present disclosure;

FIG. 6C is a perspective view, an exploded plan view, and a coupling plan view illustrating the reading/writing combination function support for a reading table according to the first embodiment of the present disclosure;

DETAILED DESCRIPTION

Figure 1:
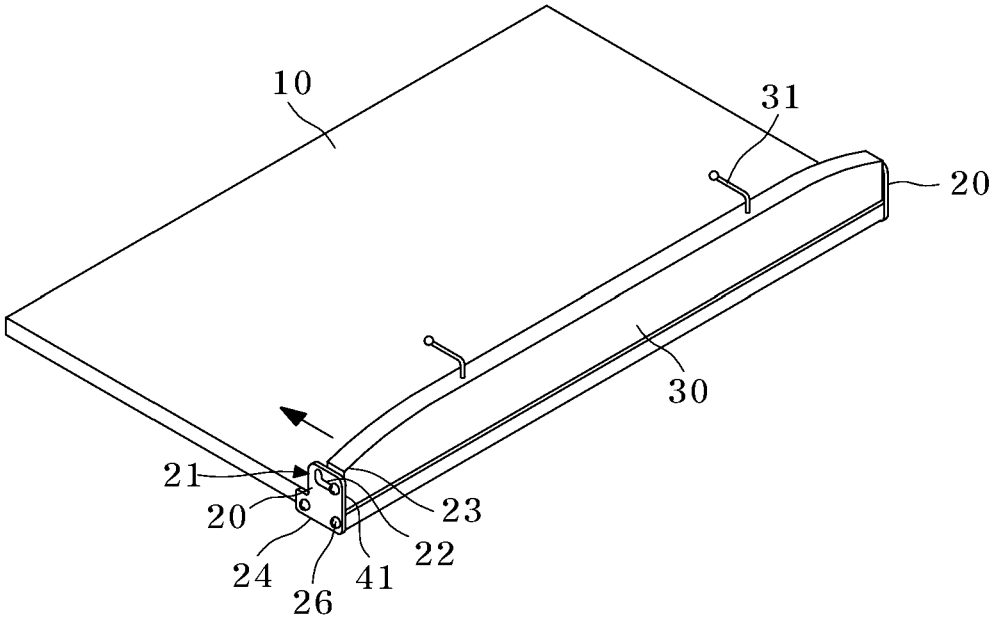
FIG. 1 is a perspective view of a reading/writing combination function support for a reading table according to conventional art.
Figure 2:
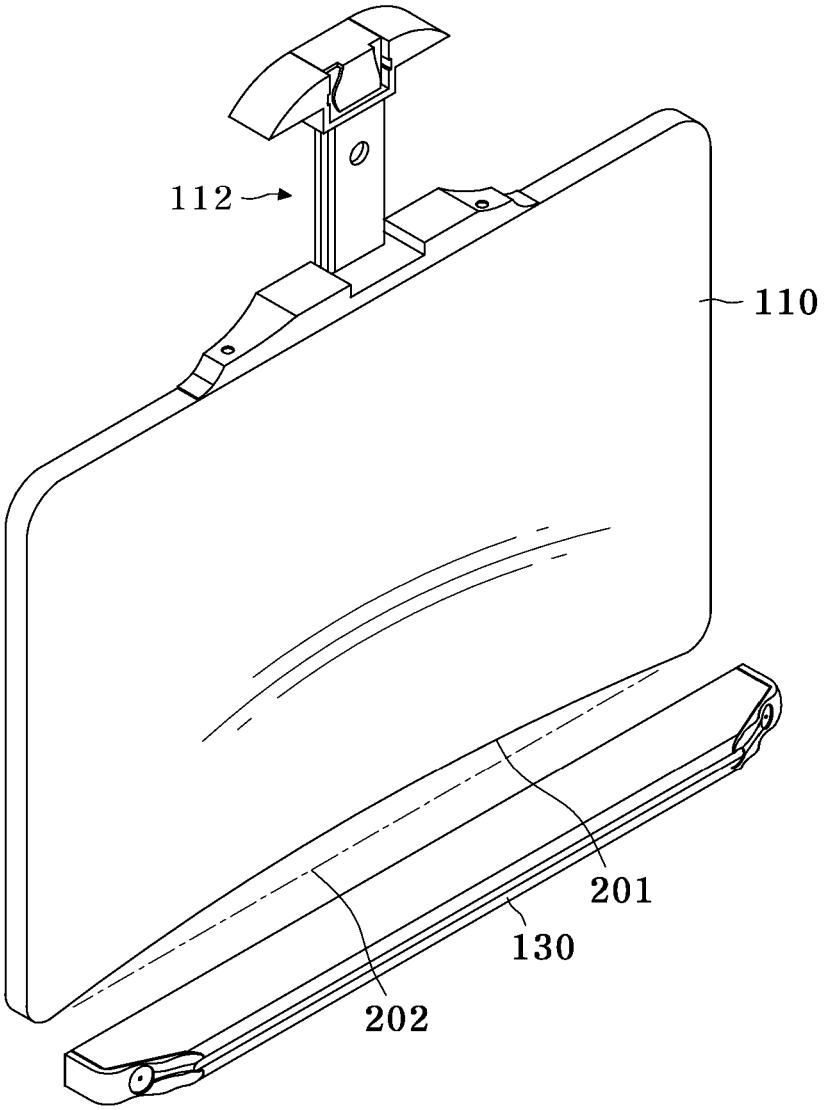
FIG. 2 is a perspective view illustrating a phenomenon in which the reading/writing combination function support for a reading table according to the conventional art is bent.
Figure 3:
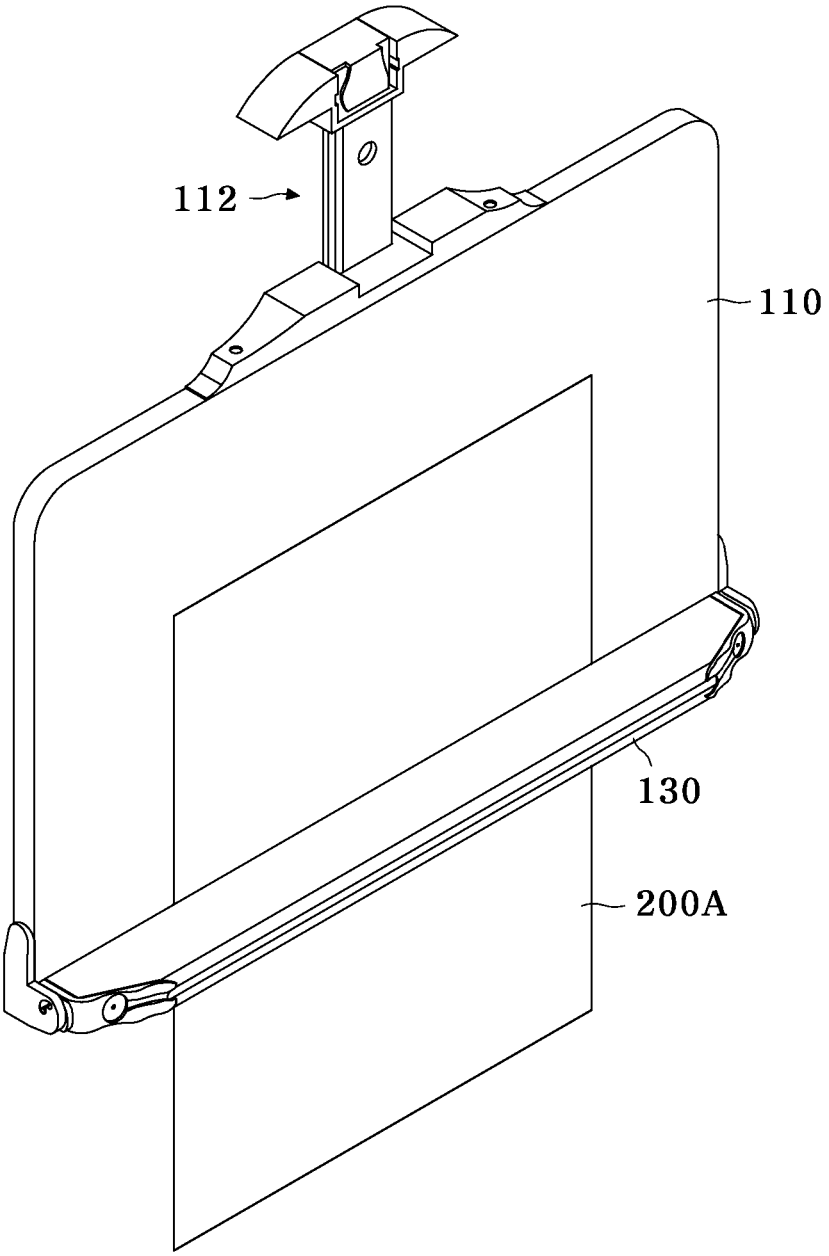
FIG. 3 is a perspective view of a state in which a paper falls out according to the bending phenomenon of the reading/writing combination function support for a reading table according to the conventional art.

Embodiments of the present disclosure may be modified in various forms, and the scope of the present disclosure should not be construed as being limited by the embodiments described below. The present embodiments are provided to more completely describe the present disclosure to those skilled in the art. Thus, the shapes and the like of components in the drawings are exaggerated in order to emphasize a clearer description.

Hereinafter, the embodiments of the present disclosure will be described in detail with reference to the accompanying drawings.

Figure 4:
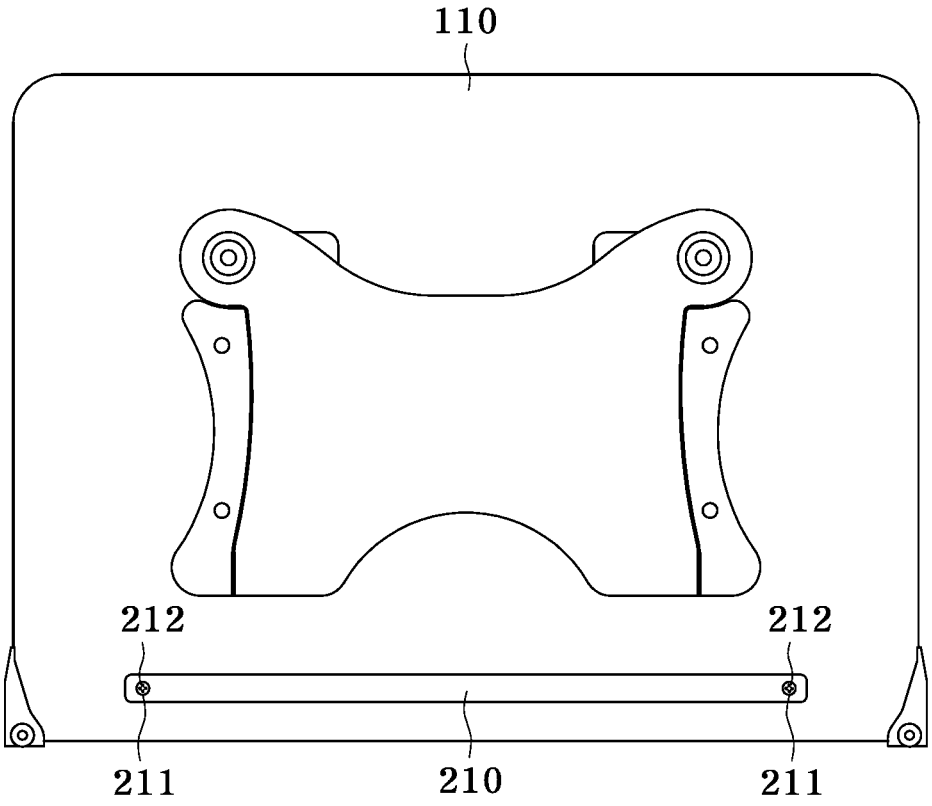
FIG. 4 is a rear view of a state in which a first embodiment of the present disclosure is installed on the rear surface of the reading/writing combination function support for a reading table according to the present disclosure.
Figure 5:
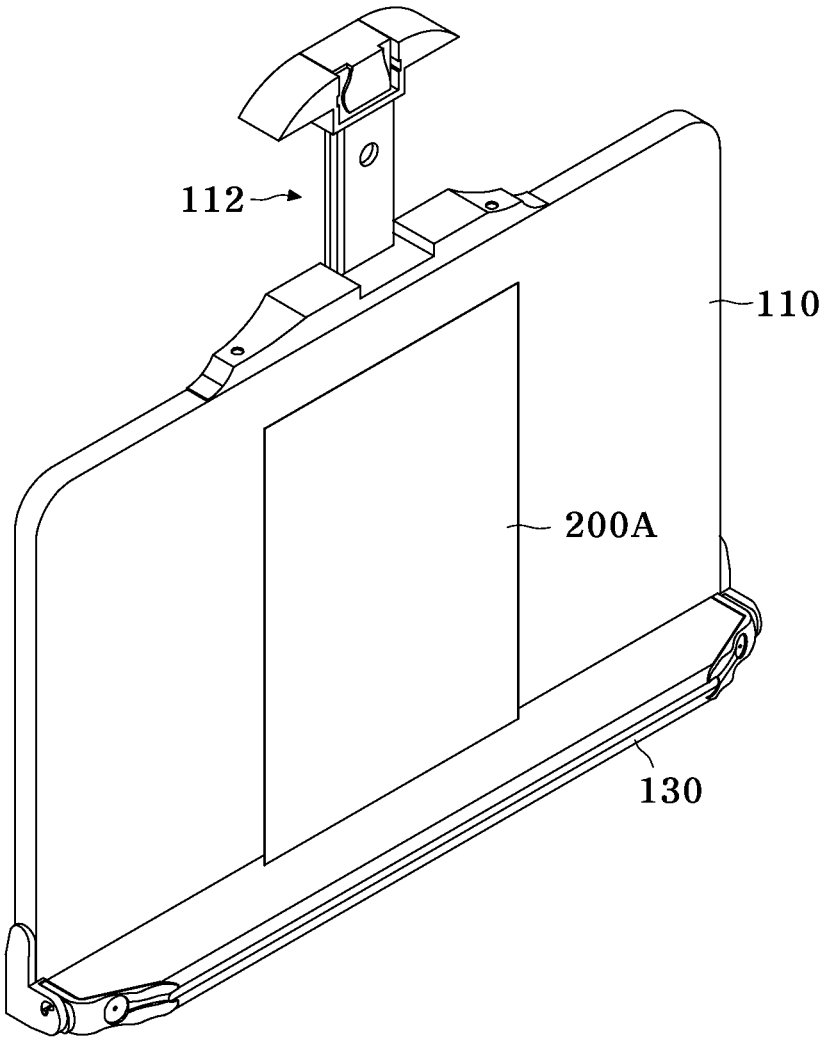
FIG. 5 is a perspective view of an effect of a state in which the first embodiment of the present disclosure is installed on the rear surface of the reading/writing combination function support for a reading table according to the present disclosure.

FIG. 4 is a rear view of a state in which a first embodiment of the present disclosure is installed on the rear surface of the reading/writing combination function support for a reading table according to the present disclosure, FIG. 5 is a perspective view of an effect of a state in which the first embodiment of the present disclosure is installed on the rear surface of the reading/writing combination function support for a reading table according to the present disclosure, and FIGS. 6A to 6C are a perspective view, an exploded plan view, and a coupling plan view illustrating the reading/writing combination function support for a reading table according to the first embodiment of the present disclosure.

Hereinafter, the embodiments of the present disclosure will be described in detail with reference to FIGS. 4 to 6.

A structure for preventing deformation of a reading table that is the present disclosure includes a reading table 110 and a quadrangular support bar 210.

The reading table 110 is a part for supporting a book and is provided with the quadrangular support bar 210 formed on the rear surface thereof together with a supporting part to maintain the reading table 110 at a constant angle.

The quadrangular support bar 210 is provided with one bolt hole 211 at each of two ends thereof in the shape of a rectangular long bar having a slightly and concavely curved center.

As an installation method, the central concave portion of the quadrangular support bar 210 is located at a rear side of the reading table 110, and a bolt 212 is inserted into and connected to the bolt hole 211 of the quadrangular support bar 210.

Since a part of the reading table 110 that may actually be bent is a central part close to a half of the entire reading table 110, a suitable ratio of the sizes of the reading table 110 and the quadrangular support bar 210 was found as a ratio of the reading table to the quadrangular support bar which is 4:3 by an experiment.

The central part of the reading table 110, which receives a convex bending force by the quadrangular support bar 210 installed in this way, receives a force, which acts in a direction opposite to the bending force, of a protruding part of the quadrangular support bar 210, and thus the reading table 110 maintains a flat surface.

Thus, as illustrated in FIG. 5, when a paper sheet or the like is used on a bookshelf in a standing state, the paper sheet does not fall off.

The quadrangular support bar 210 is made of iron, wood, plastic, or the like.

Next, a second embodiment of the present disclosure will be described.

Figure 7:
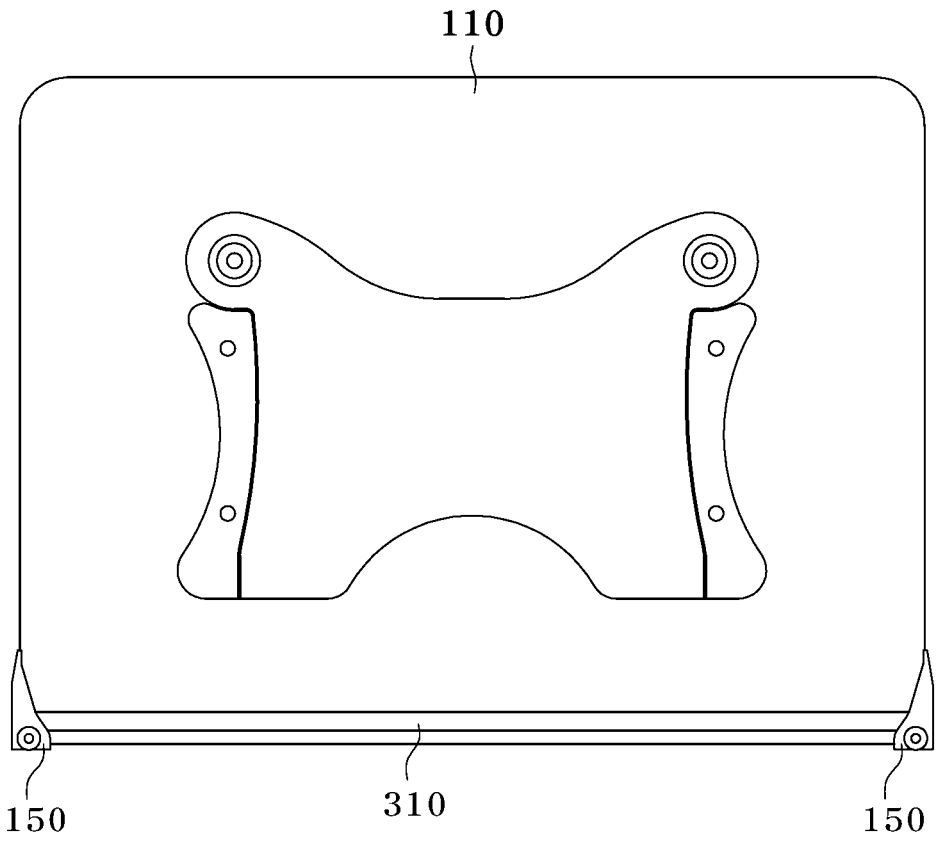
FIG. 7 is a rear view of a state in which a second embodiment of the present disclosure is installed on the rear surface of the reading/writing combination function support for a reading table according to the present disclosure.
Figure 8:
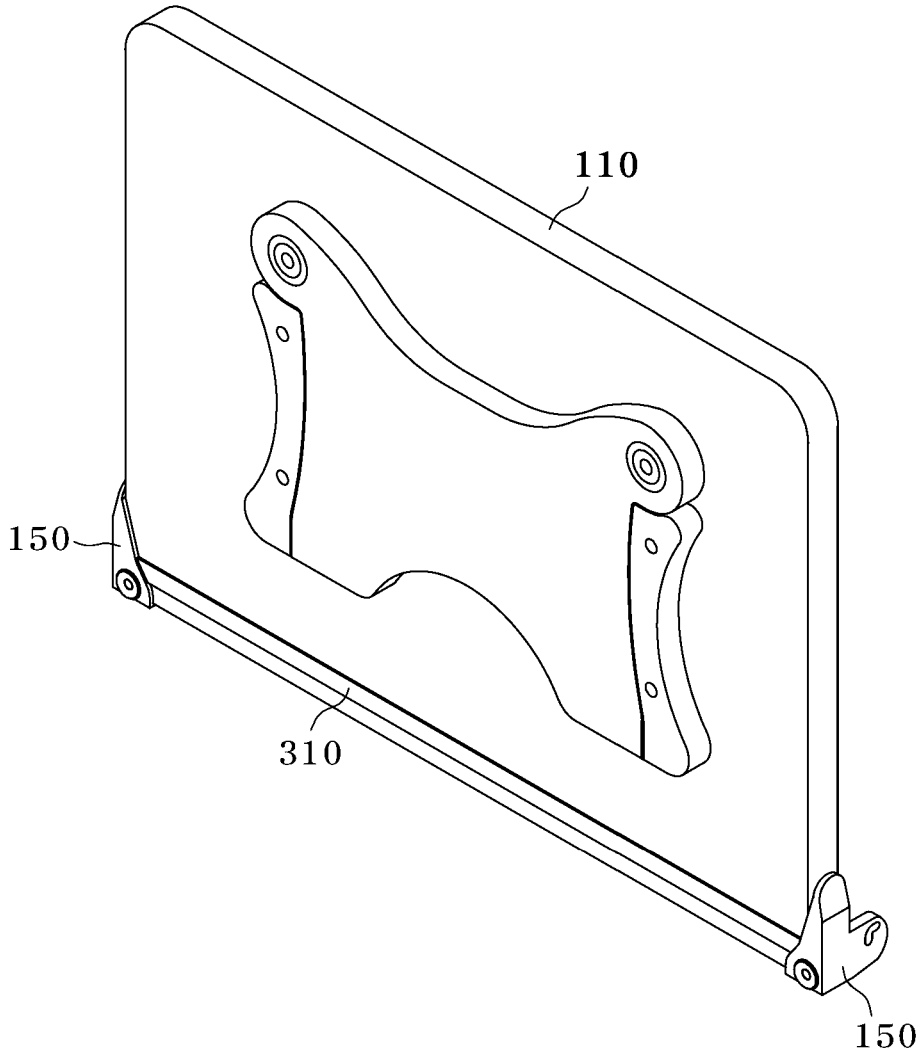
FIG. 8 is a perspective view illustrating a structure in which a reading table according to the present disclosure is separated.
Figure 9:
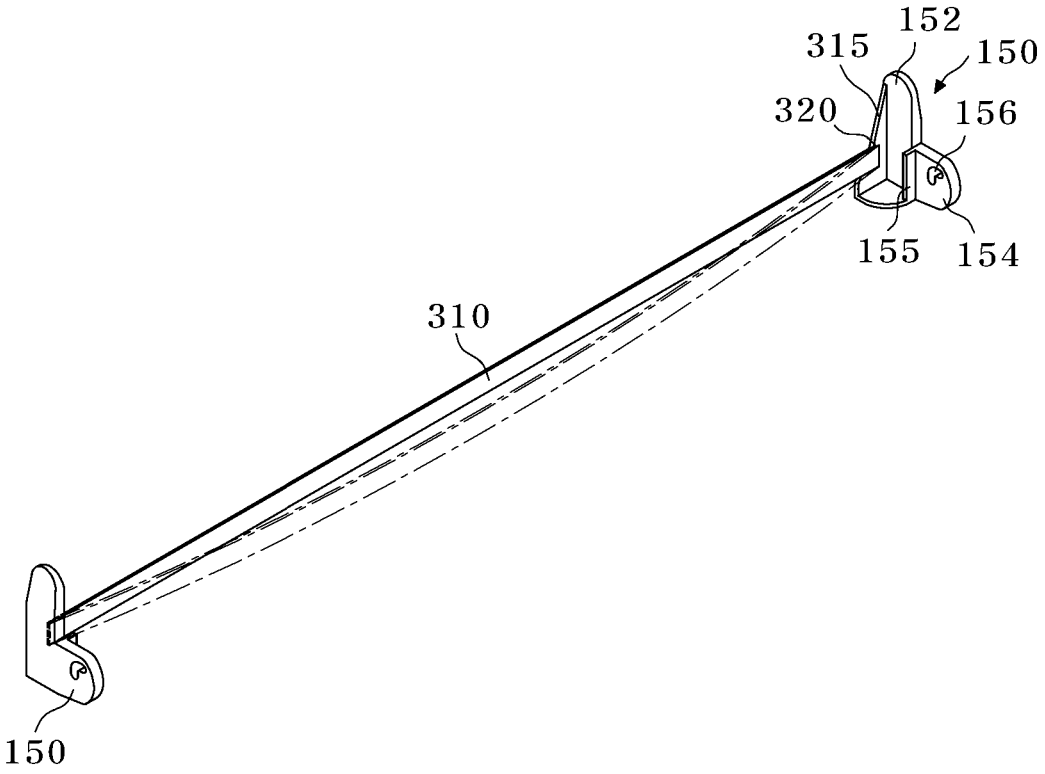
FIG. 9 is a perspective view illustrating a structure in which a reading table according to the present disclosure is coupled.
Figure 10:
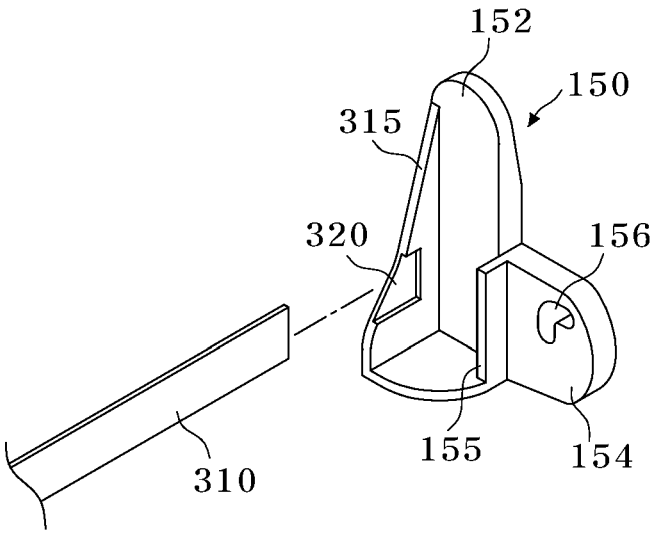
FIG. 10 is a perspective view of a second fixing body of a reading table coupler of the present disclosure.

FIG. 7 is a rear view of a state in which a second embodiment of the present disclosure is installed on the rear surface of the reading/writing combination function support for a reading table according to the present disclosure, FIG. 8 is a perspective view illustrating a structure in which a reading table according to the present disclosure is separated, FIG. 9 is a perspective view illustrating a structure in which a reading table according to the present disclosure is coupled, and FIG. 10 is a perspective view of a second fixing body of a reading table coupler of the present disclosure.

As illustrated in the drawings, the quadrangular support bar 310 behind the reading table 110 is supported by a second fixing body 150 of the reading table 110, a rear end side surface 315 that is a rear end surface of the second fixing body 150 is recessed in a quadrangular shape to form a quadrangular support bar accommodation groove 320, left and right ends of the quadrangular support bar 310 are fitted in the quadrangular support bar accommodation groove 320, and the rear end side surface 315, as a support coupling member 200, is coupled to a rear lower end of the reading table 110.

The quadrangular support bar 310 is pushed to the front side of the reading table 110 to prevent bending of the central part of the reading table 110 while left and right ends thereof are fitted due to the bending of the rigidity.

Further, in an L shape in which a second support part 152 and a second connection part 154 of the support coupling member 200 are connected, a part thereof is symmetrically coupled to lower left and right sides of a support part 130 for a book through bolts or the like, and the other part thereof is connected to a first fixing body 140.

The second support part 152 is formed to have the same thickness as the reading table 110, has a partition wall 155 surrounding the second support part 152, and is coupled to the reading table 110 through bolts or the like.

The partition wall 155 is formed to prevent the reading table 110 from being separated from the second fixing body 150 while using a folding function of the support part 130.

The second connection part 154 is provided with an L-shaped coupling hole 156, a second coupling part 146 of the first fixing body 140 is coupled to the coupling hole 156, and the support part 130 is easily folded.

Next, a third embodiment of the present disclosure will be described.

Figure 11:
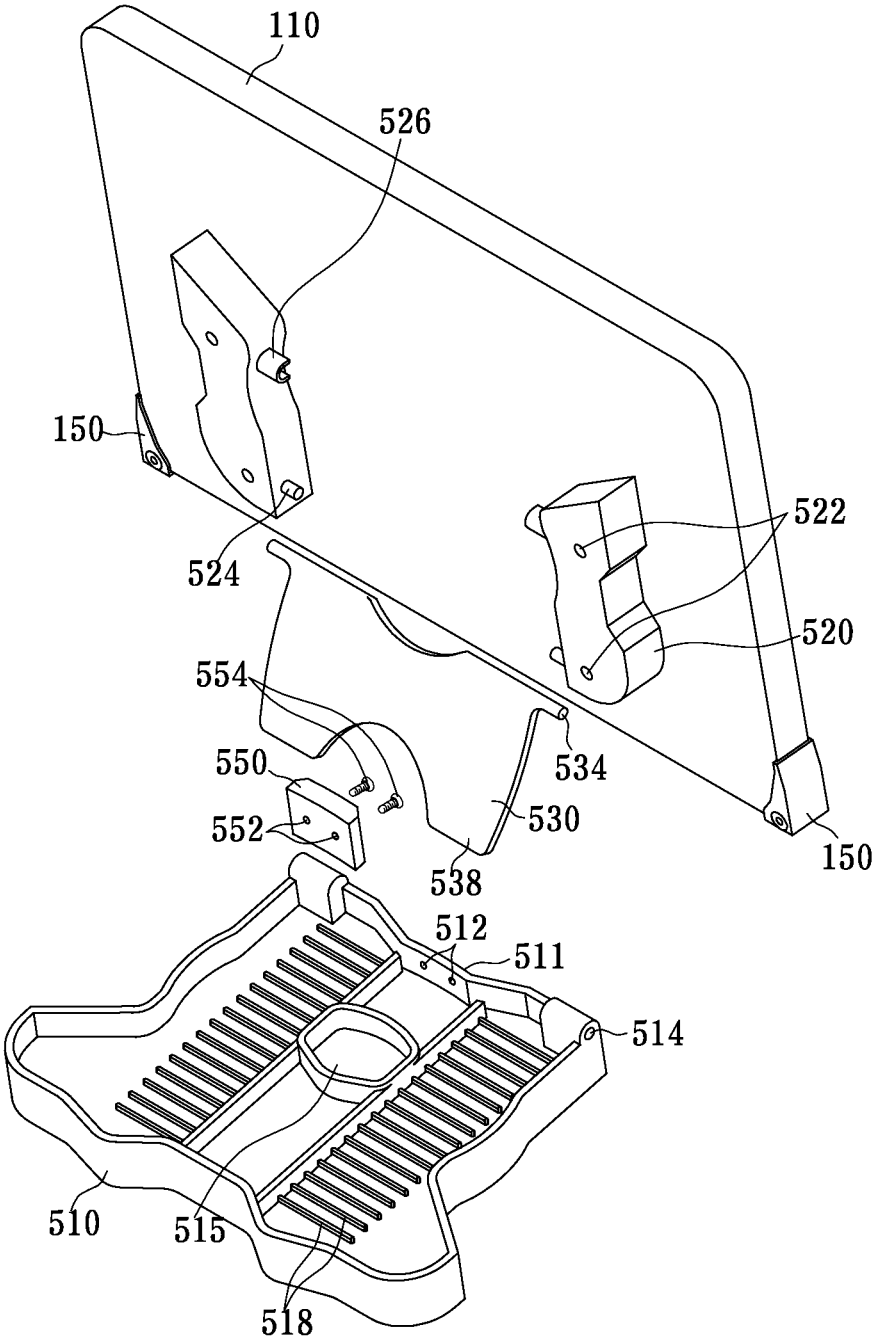
FIG. 11 is an exploded perspective view illustrating a pressing structure for preventing deformation of the reading table according to a third embodiment of the present disclosure.
Figure 12:
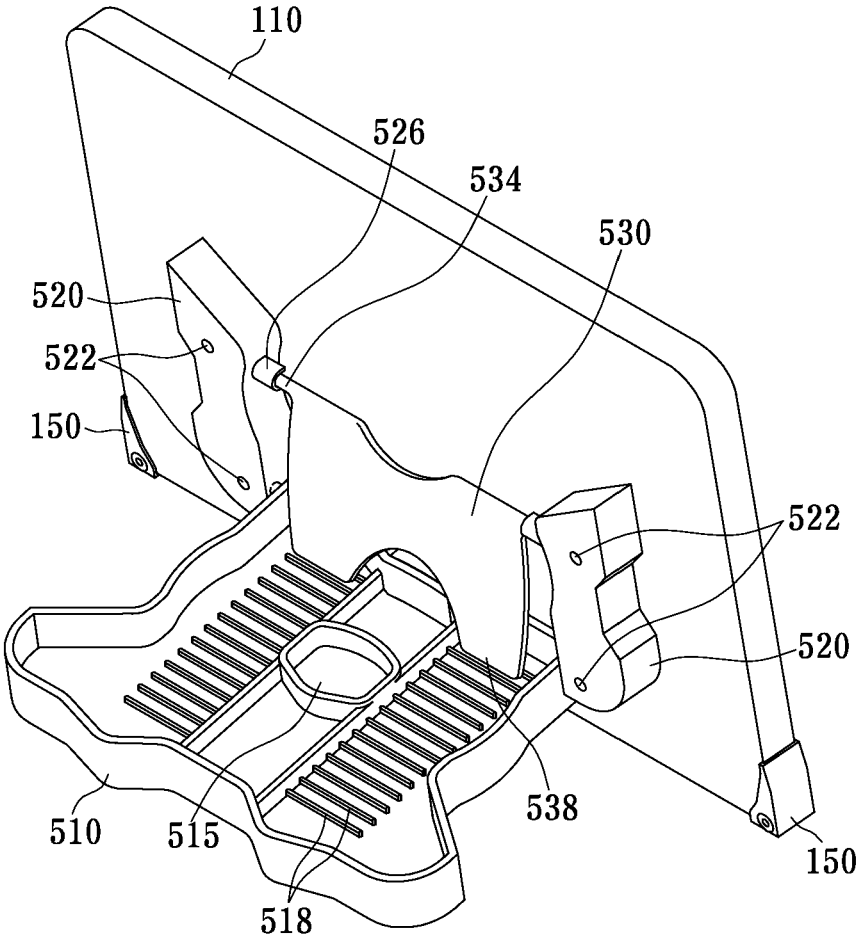
FIG. 12 is a perspective view illustrating a usage state of the pressing structure for preventing deformation of the reading table of FIG. 11.
Figure 13:
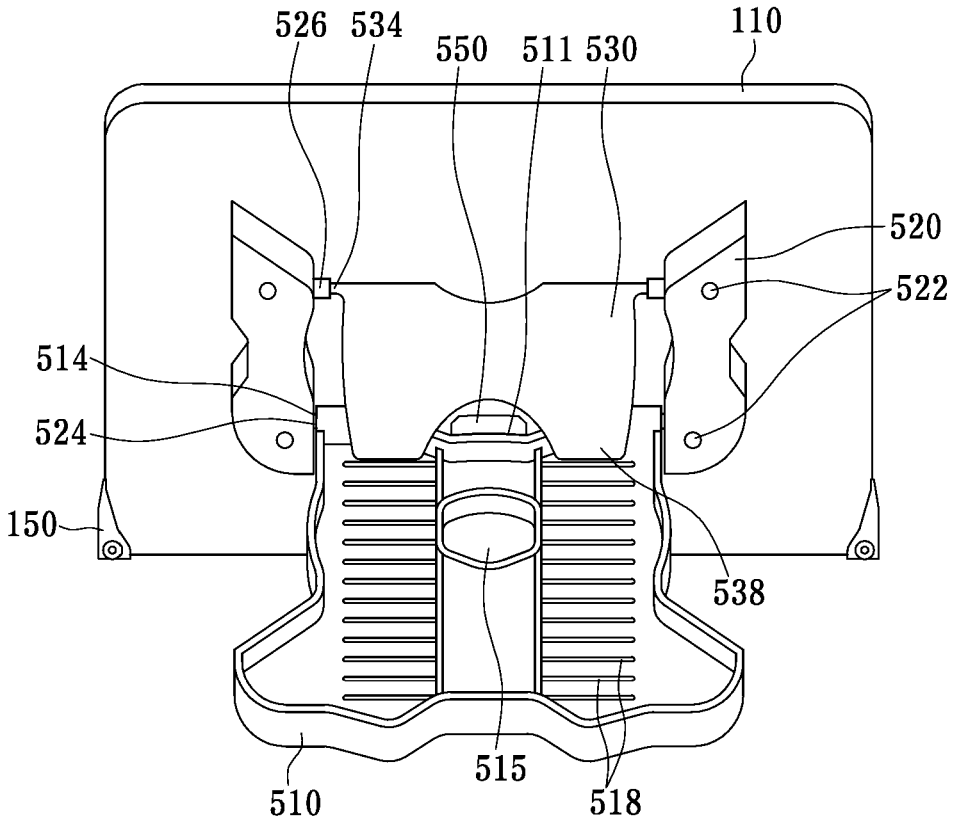
FIG. 13 is a perspective view illustrating a rear surface of the pressing structure for preventing deformation of the reading table of FIG. 11.
Figure 14:
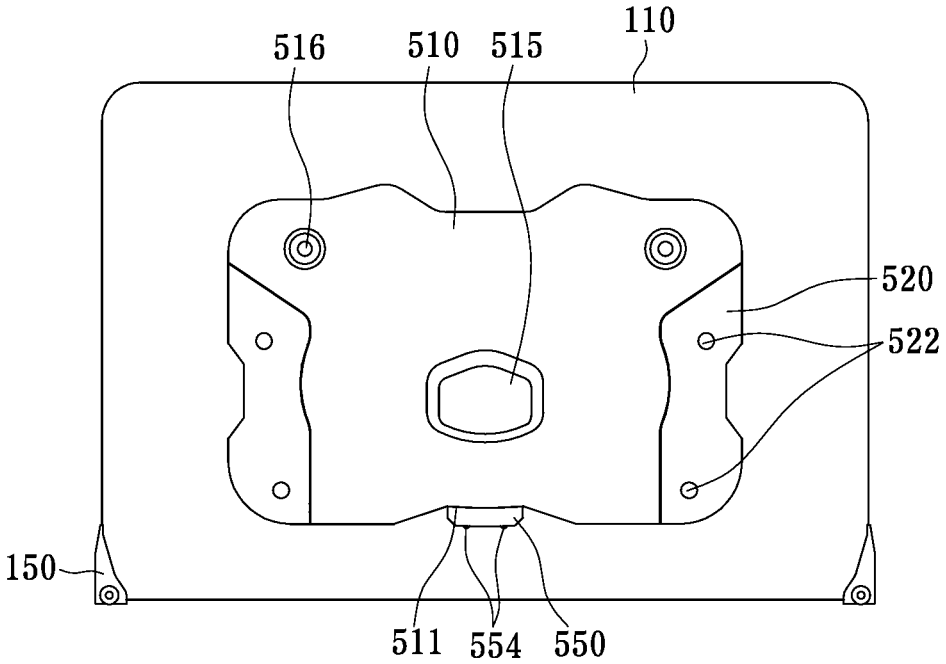
FIG. 14 is a rear view illustrating the pressing structure for preventing deformation of the reading table of FIG. 11.
Figure 15:
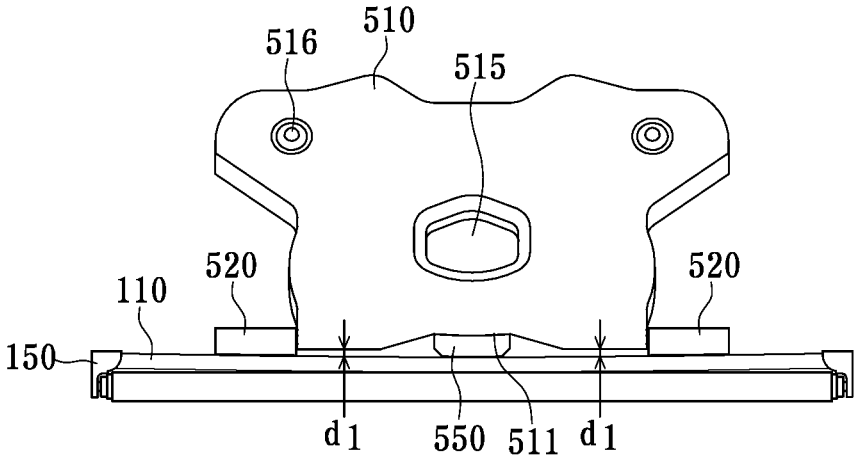
FIG. 15 is a perspective view illustrating a bottom surface of the pressing structure for preventing deformation of the reading table of FIG. 11.
Figure 16:
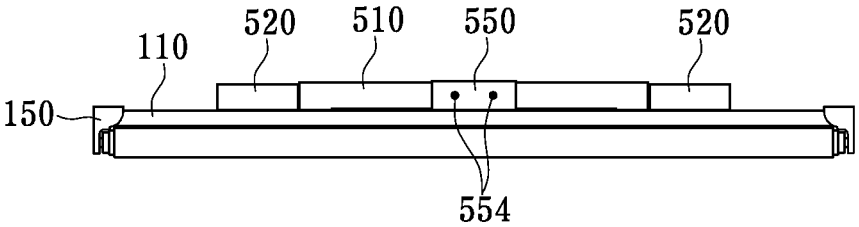
FIG. 16 is a bottom view illustrating the pressing structure for preventing deformation of the reading table of FIG. 11.

FIG. 11 is an exploded perspective view illustrating a pressing structure for preventing deformation of the reading table according to a third embodiment of the present disclosure, FIG. 12 is a perspective view illustrating a usage state of the pressing structure for preventing deformation of the reading table of FIG. 11, FIG. 13 is a perspective view illustrating a rear surface of the pressing structure for preventing deformation of the reading table of FIG. 11, FIG. 14 is a rear view illustrating the pressing structure for preventing deformation of the reading table of FIG. 11, FIG. 15 is a perspective view illustrating a bottom surface of the pressing structure for preventing deformation of the reading table of FIG. 11, and FIG. 16 is a bottom view illustrating the pressing structure for preventing deformation of the reading table of FIG. 11.

As illustrated in the drawings, a pressing structure for preventing deformation of a reading table according to the present disclosure schematically includes the reading table 110 on which a book may be placed and a support member 500 that functions to support the book and the reading table 110 and adjust the angles of the book and the reading table 110.

The above components will be described in detail as follows.

The reading table 110 is formed as a rectangular wooden board that functions to support books such as reference books, textbooks, and novel books.

The support member 500 includes a first support member 510 coupled to second support members 520 and an angle adjustment member 530 to support the reading table 110, the pair of second support members 520 attached to left and right sides of a rear surface of the reading table 110, the angle adjustment member 530 that adjusts an angle using a rotation function, and a pressing member 550 that is attached to the first support member 510 to press the reading table 110.

The first support member 510 includes a pressing member coupling part 511 provided with a pair of coupling holes 512 and located at the center of a lower end thereof, a pair of coupling holes 514 located on left and right lower side surfaces thereof, a pair of sliding prevention parts 516 located on upper outer left and right surfaces thereof, and a plurality of locking steps 518 located on an inner surface thereof.

The second support member 520 includes a plurality of coupling holes 522 formed at upper and lower sides thereof for coupling with the reading table 110, a fitting part 524 located on a lower side surface thereof and protruding toward the center of the reading table 110, and a coupling part 526 having a hole therein so as to be coupled with the angle adjustment member 530 and protruding from an upper side surface thereof toward the center of the reading table 110.

The angle adjustment member 530 includes a pair of fitting parts 534 that are fitted in the coupling parts 526 of the second support members 520 and protrude from two upper ends thereof and locking parts 538 that are coupled to the locking steps 518 of the first support member 510 and are located at a lower end thereof.

The pressing member 550 is formed in a rectangular parallelepiped shape having a plurality of coupling holes 552 and is located in the pressing member coupling part 511 of the first support member 510, and the coupling holes 552 of the pressing member 550 and the coupling holes 512 of the first support member 510 are coupled through screws 554.

Further, the fitting parts 524 of the pair of second support members 520 are fitted in the left and right coupling holes 514 of the first support member 510 to which the pressing member 550 is attached, respectively, and the fitting parts 534 of the angle adjustment member 530 are fitted in the coupling parts 526 of the second support members 520, respectively.

Further, since the pressing member 550 is located at the center of the rear surface of the reading table 110, when the first support member 510 is rotated at a predetermined angle, the center of the reading table 110 is pushed by the support member 500, and thus a predetermined interval dl between two lower edge portions of the first support member 510 and the reading table 110 may be forcibly formed.

Undescribed reference numeral 515 denotes a through-hole which is used for folding while a finger is inserted.

A coupling of the pressing structure for preventing deformation of a reading table that is the present disclosure is as follows.

First, the first support member 510 and the pressing member 550 are coupled using the screws 554 through the coupling holes 512 and the coupling holes 552.

The fitting parts 524 of the pair of second support members 520 are fitted in the left and right coupling holes 514 of the first support member 510 to which the pressing member 550 is attached, respectively, and the fitting parts 534 of the angle adjustment member 530 are fitted in the coupling parts 526 of the second support members 520, respectively.

The support member 500 obtained by coupling components to each other in this way is located at the center of the rear surface of the reading table 110 and is screw-coupled to the reading table 110 through the coupling holes 522 of the second support member 520.

The pressing structure for preventing deformation of a reading table according to the present disclosure prevents deformation of the reading table itself, solves a problem that a gap is generated when the support of the reading table is rotated and coupled, prevents a book and a paper placed on the reading table by a user from falling into the gap, and thus can be conveniently used.

Figure 17:
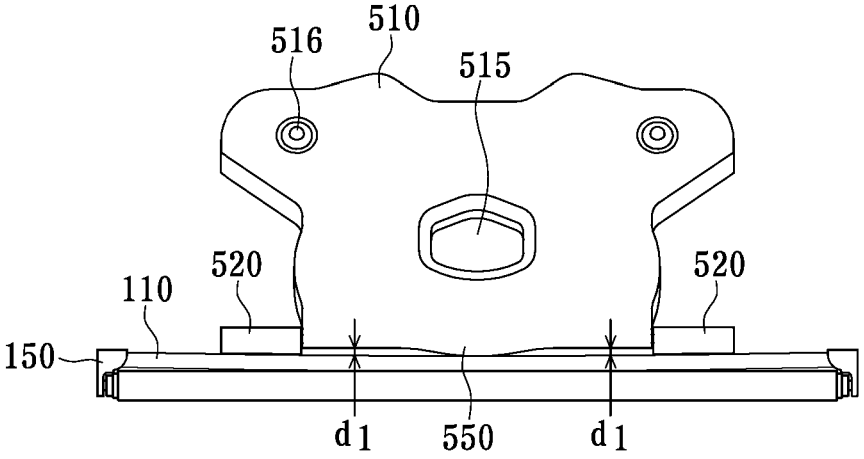
FIG. 17 is a view illustrating the pressing structure for preventing deformation of the reading table of FIG. 11 according to a first modification.
Figure 18:
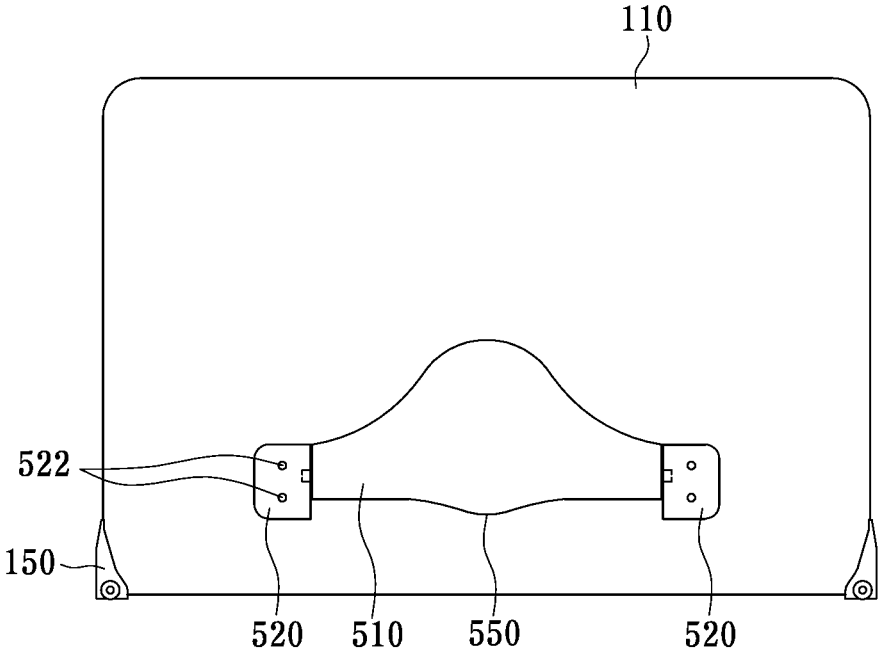
FIG. 18 is a view illustrating the pressing structure for preventing deformation of the reading table of FIG. 11 according to a second modification.

Further. FIG. 17 is a view illustrating the pressing structure for preventing deformation of the reading table of FIG. 11 according to a first modification, and FIG. 18 is a view illustrating the pressing structure for preventing deformation of the reading table of FIG. 11 according to a second modification.

As illustrated in the drawings, a pressing structure for preventing deformation of a reading table according to another embodiment of the present disclosure is configured so that the pressing member 550 is formed integrally with the first support member 510 together with the second support member 520 and the angle adjustment member 530.

The pressing structure may be manufactured by adding the angle adjustment member on the basis of the above configuration and, according to an already developed structure, may be coupled to the first support member 510 that is coupled to the reading table 110 formed of a rectangular wooden board and includes the plurality of locking steps 518 located on an inner surface thereof, the pair of second support members 520 that are attached to left and right sides of the rear surface of the reading table 110, and the angle adjustment member 530 that includes the pair of fitting parts 534 protruding from two upper ends thereof and the locking parts 538 located at a lower end thereof.

This has the effect of reducing manufacturing costs.

Thus, the present disclosure has the effect of preventing deformation, such as bending of a reading table itself, to prevent a paper or the like from falling out, and the present disclosure has the effect of providing a fastening structure that forms a fixing part of the book support 30 so that the book support 30 is not shaken along a fine thickness of the book support reading table 10 manually made of wood, is fitted at the same width, and thus is not shaken when being fixed.

Further, the present disclosure has the effect of preventing bending by recessing a quadrangular support bar accommodation groove in a quadrangular shape in a rear end side surface that is a rear end surface of a second fixing body so that the reading table is pushed forward to prevent bending of a central part of the reading table 110 while left and right ends of a quadrangular support bar are fitted and, at the same time, has the effect of doubling the work efficiency because the reading table is fitted and coupled to the left and right second fixing bodies.

Further, the present disclosure has the effect of preventing a paper from falling out because a support member and a pressing member can be formed integrally or separately so that bending of the reading table itself can be simply prevented using the existing product.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

What is claimed is:

1. A structure for preventing deformation of a reading table, the structure comprising:

a reading table that is formed of a rectangular wooden board;

a first support member that includes a plurality of locking steps located on an inner surface thereof;

a pair of second support members that are attached to left and right sides of a rear surface of the reading table;

an angle adjustment member that includes a pair of fitting parts protruding from two ends of an upper portion thereof and locking parts located at a lower end thereof; and a pressing member that has a plurality of coupling holes and has a rectangular parallelepiped shape;

wherein the pressing member is located in a pressing member coupling part of the first support member, and the first support member and the pressing member are coupled through coupling holes and the coupling holes using screws;

wherein fitting parts of the pair of second support members are each fitted in a corresponding one of coupling holes on left and right sides of the first support member to which the pressing member is attached, and the fitting parts of the angle adjustment member are each fitted in a corresponding one of coupling parts of the second support members;

the pressing member is located at a center of the rear surface of the reading table, and when the first support member is rotated at a predetermined angle, a central part of the reading table is pressed by the first support member, and thus a predetermined interval is forcibly formed between the reading table and lower corners of two sides of the first support member.

2. A structure for preventing deformation of a reading table, the structure comprising:

a reading table that is formed of a rectangular wooden board;

a first support member that includes a plurality of locking steps located on an inner surface thereof;

a pair of second support members that are attached to left and right sides of a rear surface of the reading table;

an angle adjustment member that includes a pair of fitting parts protruding from two ends of an upper portion thereof and locking parts located at a lower end thereof; and a pressing member formed to protrude from a center of the first support member, and formed in a rounded shape at the same time;

wherein fitting parts of the pair of second support members are each fitted in a corresponding one of coupling holes on left and right sides of the first support member to which the pressing member is attached, and the fitting parts of the angle adjustment member are each fitted in a corresponding one of coupling parts of the second support members;

the pressing member is located at a center of the rear surface of the reading table, and when the first support member is rotated at a predetermined angle, a central part of the reading table is pressed by the first support member, and thus a predetermined interval is forcibly formed between the reading table and lower corners of two sides of the first support member.

* * * * *